US009566622B2

(12) United States Patent
Guo et al.

(10) Patent No.: US 9,566,622 B2
(45) Date of Patent: Feb. 14, 2017

(54) AUTOMATIC VACUUM SEWERAGE SOLIDS CLEANING SYSTEMS AND METHODS

(71) Applicants: Qizhong Guo, Belle Mead, NJ (US); Yunjie Li, Highland Park, NJ (US)

(72) Inventors: Qizhong Guo, Belle Mead, NJ (US); Yunjie Li, Highland Park, NJ (US)

( * ) Notice: Subject to any disclaimer, the term of this patent is extended or adjusted under 35 U.S.C. 154(b) by 155 days.

(21) Appl. No.: 14/207,863

(22) Filed: Mar. 13, 2014

(65) Prior Publication Data

US 2014/0261735 A1 Sep. 18, 2014

Related U.S. Application Data

(60) Provisional application No. 61/779,039, filed on Mar. 13, 2013.

(51) Int. Cl.

| | |
|---|---|
| ***B08B 9/08*** | (2006.01) |
| ***E03F 5/10*** | (2006.01) |
| ***E03F 9/00*** | (2006.01) |

(52) U.S. Cl.

CPC ..... *B08B 9/0856* (2013.01); *E03F 5/108* (2013.01); *E03F 9/007* (2013.01); *Y10T 137/0424* (2015.04); *Y10T 137/4245* (2015.04)

(58) Field of Classification Search

CPC ..... B08B 9/0856; E03F 9/00; E03F 9/007; E03F 5/108

USPC ..... 137/217

See application file for complete search history.

(56) References Cited

U.S. PATENT DOCUMENTS

| | | | | |
|---|---|---|---|---|
| 1,918,678 | A * | 7/1933 | Wirz, Jr. | E03F 5/0402 137/124 |
| 3,661,261 | A * | 5/1972 | Lemke | E03F 5/0402 134/21 |
| 4,905,325 | A * | 3/1990 | Colditz | B64D 11/02 134/166 R |
| 5,333,630 | A * | 8/1994 | Jepsen | B05B 3/0445 134/104.1 |
| 5,387,054 | A * | 2/1995 | Richter | E03F 5/101 134/169 R |
| 6,655,402 | B1 * | 12/2003 | Fan | E03F 5/105 137/1 |
| 2010/0032032 | A1 * | 2/2010 | Davenport | E02B 13/02 137/581 |

* cited by examiner

*Primary Examiner* — Craig Schneider
*Assistant Examiner* — Kevin Barss
(74) *Attorney, Agent, or Firm* — Fox Rothschild LLP

(57) ABSTRACT

This application discloses novel vacuum break devices useful in automatic vacuum flushing systems. The vacuum break devices are capable of rapidly breaking the vacuum in a storage tank of a sewer line, thus enabling efficient flushing of sediments and cleaning of the sewer system. The invention also provides automatic vacuum flushing systems comprising these novel rapid vacuum break devices and methods thereof for sewer or storage tank sediment cleaning in urban drainage systems.

20 Claims, 4 Drawing Sheets

*Automatic Flushing System 1:*

*Automatic Flushing System 2:*

AUTOMATIC VACUUM SEWERAGE SOLIDS CLEANING SYSTEMS AND METHODS

CROSS REFERENCE TO RELATED APPLICATIONS

This application claims the benefit under 35 U.S.C. §119 (e) of U.S. Provisional Application No. 61/779,039, filed on Mar. 13, 2013, which is incorporated herein by reference.

FIELD OF THE INVENTION

The present invention relates generally to water quality management, and more specifically to vacuum break devices useful for flushing systems and flushing systems equipped with such novel vacuum break devices, as well as methods for sewer system cleaning, in particular, efficient flushing and cleaning of solid sediments accumulated in sewer systems.

BACKGROUND OF THE INVENTION

Currently, in many old cities of the United States, the sewer network systems consist of combined sewer systems, separated sanitary sewer systems, and storm water sewer systems. A combined sewer is designed to collect the combined sewage of domestic and industrial wastewater, and storm water runoff in the same pipe. A separated sanitary sewer is designed to collect domestic and industrial wastewater. However, a storm water sewer is used to collect storm water runoff only. During the periods of dry weather or light rainfall, the urban sewer network transports all of the collected combined sewage from combined sewer systems and wastewater from sanitary sewer systems to a treatment plant to receive full treatment before discharging to a nearby water body. However, during heavy storm events, the quantity (flow rate and volume) of the collected sewage and storm water runoff in a combined sewer system may surpass the designed capacity of the sewer system or the treatment plant. When this situation occurs, the excess flows will inevitably overflow to a nearby water body. These overflows are known as combined sewer overflows (CSOs). With increasing frequency super storms in recent years, for example, Hurricanes Katrina, Irene and Sandy, have caused flood and overflow of urban sewer systems and devastating damages to both properties and humans.

Combined sewer overflows can cause serious water pollution problem. The deposition of sewage solids during dry weather in combined sewer systems has long been recognized as a major source of receiving water pollution. One of the underlying reasons for considerable sewage solids deposition is the combined sewer hydraulic design. Dry-weather flow velocities are typically inadequate to maintain settleable solids in suspension, and a substantial amount of solids tend to accumulate in the sewer systems. During rain storms, the accumulated solids may re-suspend, and overflow to receiving waters due to the limited hydraulic capacity of the interceptor. Suspended solids concentrations of several thousand parts per million are not uncommon for CSOs. This can produce shock loadings detrimental to receiving water. Development of a means to control or remove sedimentary deposits is required to prevent their undesirable effects.

The control of CSOs employing structural measures such as sewer separation, storage and treatment has been used in a number of major cities in the United States. Nationwide application of these techniques for the control of CSOs would require expenditures over 100 billion dollars. New strategies are needed to reduce these costs to tolerable limits. Sewer sediment flushing can significantly reduce overall costs when integrated with other upstream management practices and downstream storage tanks. Engineered sewer sediment flushing systems are low-cost control alternatives which can be viewed as an added measure for structural control and treatment. In some cases, the CSO storage-sedimentation facility may be more cost effective for controlling suspended solids and associated pollutants; however, it requires efficient flushing systems for removing tank bottom sediments.

Concern over sewer flushing can be dated back to the Romans. In the U.S., early historical efforts for sewer sediment cleaning occurred in Syracuse, N.Y. at the turn of the century. The method for sewer cleaning is to create a flushing wave to scour and transport the deposited sediments to a storage sump by rapidly adding external water or by quickly opening a flushing gate.

Currently significant work has been invested to achieve a cost effective means to purge the sediment deposited in combined sewers, CSO storage tanks, and storm water conveyance systems via a variety of flushing techniques. Existing flushing technologies include Hydrass®, Hydroself®, Biogest®, Huber Power Flush®. All of these flushing systems require either an external sources of water and/or energy or complex control mechanism. Therefore, United States Environmental Protection Agency (USEPA) further developed a sediment flushing system as disclosed in U.S. Pat. No. 6,655,402 to C.-Y. Fan, which is hereby incorporated by reference. The USEPA's system can be installed either in a CSO storage tank or in a combined sewer. Notably, the invention creates effective hydraulic waves without the use of an outside energy source, but uses water from the storm event itself. However, a major limitation of USEPA's flushing system is that when the water level outside the flushing tank drops slowly (near the opening of the vacuum break pipe), the flushing wave is weak. This is caused by a direct relationship between the completed vacuum break time and the speed at which water is released from the flushing tank.

Therefore, to effectively remove sewer solids from urban drainage systems between storms, a flushing system with high efficiency and cost effectiveness, yet without need of external sources of water and energy and complex control instrumentation, is still urgently needed.

SUMMARY OF THE INVENTION

The present invention fulfills the foregoing need by providing novel vacuum break devices useful in automatic vacuum flushing systems and the automatic vacuum flushing systems including these novel rapid vacuum break devices. The vacuum break devices disclosed herein are capable of rapidly breaking the vacuum in a storage tank of a sewer line, thus enabling efficient flushing of sediments and cleaning the sewer system. Thus, the invention provides novel automatic vacuum flushing systems and methods thereof for sewer or storage tank sediment cleaning in urban drainage systems.

In one aspect, the present invention provides an automatic vacuum flushing system for flushing or cleaning sewer or storage tank sediment in a drainage system, comprising a flush water chamber, an air release valve on the top of the flush water chamber, and a vacuum-break device connected to the top of the flush water chamber through a pipe, wherein the flush water chamber comprises an opening of a predetermined size in its lower part of the drainage downstream side and is in fluid communication with the drainage system through the opening;

wherein the flush water chamber substantially fills up with water from the drainage through the opening when the water level in the storage tank or sewer rises; a vacuum is created in the headspace of the flush water chamber when water in the sewer or storage tank is drained; and when water in the storage tank or sewer falls below a predetermined level, the vacuum-break device rapidly breaks the vacuum, thereby discharging the water in the flush water chamber in a surge to flush the sewer or storage tank.

In another aspect, the present invention provides a sewer line comprising an automatic vacuum flushing system according to any embodiment(s) as described herein.

In another aspect, the present invention provides a vacuum break device for an automatic vacuum flushing system, comprising:

a chamber formed by an outside screen wall, a bottom plate and a top plate;

a plurality of bars installed vertically connecting the top and bottom plates of the chamber to form a frame;

a positioning tube installed vertically on the bottom plate of the chamber;

a plurality of floatable parts, each comprising a central hole, placed along the positioning tube, the floatable parts optionally mounted on the bars of the frame through holes;

a weight positioned above one of the floatable parts; and a rubber sheet above the top of the floatable parts and directly beneath the bottom opening of the pipe coming from the top of the chamber, the rubber sheet capable of tightly sealing the pipe opening when in position;

wherein the rubber sheet, the floatable parts, and the weight are arranged so that the rubber sheet can seal the pipe opening when water level rises in the sewer or storage tank and during the formation of vacuum when the water in the sewer or storage tank is drained until a predetermined level.

In one embodiment, the floatable parts comprise:

a floating plate at the bottom directly beneath the weight;

a rubber sheet holder on the top to hold the rubber sheet, the holder comprising a plate fixed on the top of a rod, the rod inserted downwardly into said positioning tube so that the bottom floating plate, the weight, the rubber sheet holder, and the rubber sheet are aligned along the positioning tube from bottom to the top, and can freely move up and down along the positioning tube;

wherein the rubber sheet is connected to the weight by two or more strings or chains; and wherein the rubber sheet moves upward to seal the opening of the pipe when water level rises to move the floatable parts upward; a vacuum is created when the water level falls; and when the water level falls to a predetermined level, the weight applies a force to the rubber sheet through the strings or chains to rapidly break the vacuum.

In another aspect, the present invention provides a vacuum break device for automatic vacuum flushing systems, comprising:

a mechanical part fixed on the top of the flush water chamber encompassing the air release valve, and a floatable part connected to the mechanical part through a lever system, wherein the floatable part, through the lever system, causes the mechanical part to suddenly open the air release valve and break the vacuum in the headspace of the flush water chamber, when water level in the sewer or storage tank falls to a predetermined level.

In another aspect, the present invention provides an automatic vacuum flushing system for flushing or cleaning sewer or storage tank sediment in a drainage system, comprising a vacuum break device according to any embodiment described herein.

In another aspect, the present invention provides a method of flushing or cleaning sewer or storage tank sediment in a drainage system, comprising the steps of: providing at least one of the automatic vacuum flushing systems comprising a vacuum breaking device according to any embodiment(s) described herein; and placing said at least one of the automatic vacuum flushing systems in an upstream portion of the drainage system. When water level rises to substantially fill the flush water chamber, the water is drained from the sewer or storage tank to create a vacuum in the headspace of the flush water chamber; and when the water level in the sewer or storage tank falls to a predetermined level the vacuum in the headspace of the flush water chamber breaks rapidly, causing discharge of the water in the flush water chamber in a surge to flush out the sediment from the sewer or storage tank.

The efficiency of sediment cleaning from the sewer or storage tank bottom depends on the strength of the flushing wave. The strength of the flushing wave greatly depends on how quickly the water evacuates the chamber and on the volume of the water in the vacuum chamber. The speed at which water is released from the vacuum chamber greatly depends on how quickly the vacuum breaks. To satisfy this need, two novel vacuum break devices are provided in this invention. The laboratory demonstration has proven that they work in a similar manner to flushing gates, and they can be applied to any field conditions.

The present invention provides a variety of advantages, which include, for example, completely automatic operation; no external power required; no external water supply required, thus enabling flushing with rain or wastewater; self-generated vacuum during natural draining of water outside the flushing tank; quick vacuum break and high flushing strength; high cleaning performance; full flushing action even on small spills (most rain events); minimal maintenance from outside the tank, therefore providing health and safety advantages; easy installation; elimination of odor annoyance; and low material and manufacturing cost.

Additional aspects and advantages of the present invention will be readily apparent to one of skill in the art in view of the following drawings, detailed description and claims.

BRIEF DESCRIPTION OF THE DRAWINGS

The accompanied drawings illustrate the details of this invention for automatic flushing systems 1 and 2. They are described as follows.

DETAILED DESCRIPTION OF THE INVENTION

Figure 1A:
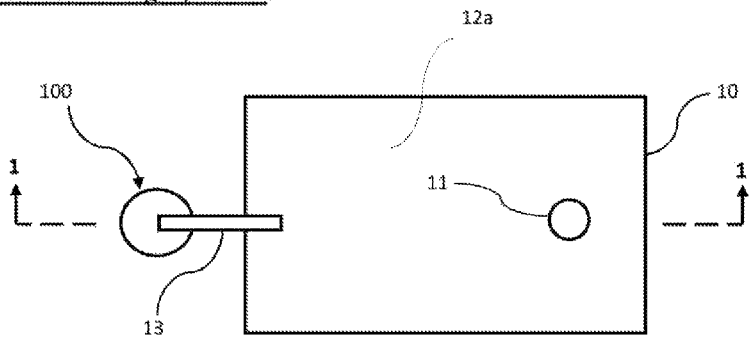
FIG. 1A illustrates a top plan view of the automatic vacuum flushing system 1 of the invention, illustrating an air release valve 11 installed on the top of the flush reservoir 10 and a rapid vacuum break device 100 connected to the top of the flush reservoir with a pipe 13, and located at the upstream or side of the reservoir.

This invention provides two automatic vacuum flushing systems with newly developed rapid vacuum break devices, respectively, for sewer and storage tank sediment cleaning in urban drainage systems (FIGS. 1 and 2). Each of the flushing systems includes a flushing water chamber, an air release valve, and a sudden vacuum break device. This system can be installed either in a storage tank, such as a sewer overflow (CSO) storage tank, or in a combined sewer line or a storm water sewer line. The chamber has an opening of a predetermined size in the lower part of the downstream side. In the upstream side it has a pipe attached to the top of chamber through an elbow and to the vacuum break device at the bottom. The flushing water chamber fills up with water that enters through the opening on the downstream side as the storage tank or sewer is filling up. When water in the storage tank or sewer is drained, a vacuum is created in the headspace of the chamber and holds the water inside. When water in the storage tank or sewer falls below the predetermined level, the vacuum break device works to suddenly break the vacuum and the water in the chamber is quickly released to the downstream of the storage tank or sewer, and thus the accumulated solids in the sewer or storage tank are flushed to a storage sump at the end of downstream for later removal.

Thus, in one aspect, the present invention provides an automatic vacuum flushing system for flushing or cleaning sewer or storage tank sediment in a drainage system, comprising a flush water chamber, an air release valve on the top of the flush water chamber, and a vacuum-break device connected to the top of the flush water chamber through a pipe, wherein the flush water chamber comprises an opening of a predetermined size in its lower part of the drainage downstream side and is in fluid communication with the drainage system through the opening;

wherein the flush water chamber substantially fills up with water from the drainage through the opening when the water level in the storage tank or sewer rises; a vacuum is created in the headspace of the flush water chamber when water in the sewer or storage tank is drained; and when water in the storage tank or sewer falls below a predetermined level, the vacuum-break device rapidly breaks the vacuum, thereby discharging the water in the flush water chamber in a surge to flush the sewer or storage tank.

In another embodiment, the vacuum-break device is located at the upstream or side of the flush water chamber.

In another embodiment, the vacuum-break device is connected to the pipe on the top of chamber through an elbow.

In another embodiment, the vacuum break device comprises:

a chamber formed by an outside screen wall, a bottom plate and a top plate;

a plurality of bars installed vertically connecting the top and bottom plates of the chamber to form a frame;

a positioning tube installed vertically on the bottom plate of the chamber;

a plurality of floatable parts, each comprising a central hole, placed along the positioning tube, the floatable parts optionally mounted on the bars of the frame through holes;

a weight positioned above one of the floatable parts; and a rubber sheet above the top of the floatable parts and directly beneath the bottom opening of the pipe coming from the top of the chamber, the rubber sheet capable of tightly sealing the pipe opening when in position;

wherein the rubber sheet, the floatable parts, and the weight are arranged so that the rubber sheet can seal the pipe opening when water level rises in the sewer or storage tank and during the formation of vacuum when the water in the sewer or storage tank is drained until a predetermined level.

In another embodiment, the floatable parts comprise:

a floating plate at the bottom directly beneath the weight;

a rubber sheet holder on the top to hold the rubber sheet, the holder comprising a plate fixed on the top of a rod, the rod inserted downwardly into said positioning tube so that the bottom floating plate, the weight, the rubber sheet holder, and the rubber sheet are aligned along the positioning tube from bottom to the top, and can freely move up and down along the positioning tube;

wherein the rubber sheet is connected to the weight by two or more strings or chains; and wherein the rubber sheet moves upward to seal the opening of the pipe when water level rises to move the floatable parts upward; a vacuum is created when the water level falls; and when the water level falls to a predetermined level, the weight applies a force to the rubber sheet through the strings or chains to rapidly break the vacuum.

In another embodiment, the floatable parts further comprise a positioning part placed between the weight and the rubber sheet holder, wherein the positioning part has freedom to move upward and downward along the positioning tube and, when water level rises to a predetermined level, applies a lift force to the rubber sheet holder to force the rubber sheet to seal the opening of the pipe.

In another embodiment, the bottom floatable part and the weight have holes traversed through by the same number of bars.

In another embodiment, the number of bars is four (4).

In another embodiment, the vacuum break device comprises:

a mechanical part fixed on the top of the flush water chamber encompassing the air release valve; and a floatable part connected to the mechanical part through a lever system, wherein the floatable part, through the lever system, causes the mechanical part to suddenly open the air release valve and break the vacuum in the headspace of the flush water chamber, when water level in the sewer or storage tank falls to a predetermined level.

In another embodiment, the mechanical part comprises:

a shooting part connected to a lever arm of said lever system through a connecting means (e.g., a pin, pivot, or the like) and capable of moving up and down along a positioning rod, the shooting part connected to the top of the flush water chamber through a spring wrapping around the positioning rod, both the spring and positioning rod fixed on the top of the flush water chamber, optionally through a positioning plate, and a handle fixed on the shooting part, the handle connected to the air release valve through a string or chain, wherein the shooting part is capable of opening and closing the air release valve through the string or chain connecting the handle and the valve.

In another embodiment, the mechanical part further comprises a supporting structure to hold the pivot of the lever system, and a positioning structure to hold the shooting part in place when the air release valve is closed.

In another embodiment, the floatable part is located at the upstream or a side of the flush water chamber.

In another embodiment, the drainage system is selected from the group consisting of combined sewer systems, separated sanitary sewer systems, and storm water sewer systems.

In another embodiment, the drainage system comprises at least one sewer line or storage tank for one or more of combined sewer overflow, separated sanitary sewer overflow, and storm water overflow.

In another embodiment, the velocity of the flushing water surge is at least at a level sufficient to suspend and flush out the sediment, said level of velocity being dependent on sizes and specific gravity of the sediment or field deposits.

In another embodiment, the level of the velocity of the flushing water surge is at least about 1 m/s, at least about 2 m/s, at least about 3 m/s, or at least about 4 m/s.

In another embodiment, the opening in the lower part of the flush water chamber is at least about one inch above the historical height of the sewer or storage tank sediment layer immediately downstream of the flush water chamber.

In another embodiment, the opening in the lower part of the flush water chamber is at least about two inches, at least about three inches, or at least about four inches above the historical height of the sewer or storage tank sediment layer immediately downstream of the flush water chamber.

In another embodiment, the size of said opening in the lower downstream part of the flush water chamber is determined based on required velocity of the flushing water surge, volume of flush chamber, and field conditions.

In another embodiment, the predetermined water level in the sewer or storage tank for vacuum-break is located at the level immediately above the top of the opening.

In another embodiment, the predetermined water level in the sewer or storage tank for vacuum-break is located within about one inch, about two inches, or about three inches above the top of the opening.

In another embodiment, the volume of the flush water chamber is determined based on the volume of the storage tank or the volume of the total length of sewer line to be flushed so that the velocity of the flushing water surge at least meets the required minimum average velocity to suspend and flush out the sediment from the storage tank or the sewer line.

In another embodiment, the volume of the flush water chamber is at least about 5-10%, at least about 10-15%, about 15-20%, or about 20-25% of the volume of the storage tank or at least about 10-20%, about 20-30%, about 30-40%, about 40-50%, or about 50-60% of the volume of the total length of sewer line to be flushed.

In another embodiment, the volume of the flush water chamber is about 10-20 percent of the volume of the storage tank or about 20-50 percent of the volume of the total length of sewer line to be flushed.

In another aspect, the present invention provides a sewer line comprising an automatic vacuum flushing system according to any embodiment as described herein.

In one embodiment of this aspect, the sewer line comprises a plurality of the automatic vacuum flushing system along the sewer line.

In another embodiment of this aspect, at least one automatic vacuum flushing system is installed per about 300 to about 1500 feet along the sewer line.

In another embodiment of this aspect, at least one automatic vacuum flushing system is installed per about 500 to about 1000 feet along the sewer line.

In another embodiment of this aspect, at least one automatic vacuum flushing system is installed per about 600 to about 800 feet along the sewer line.

In another embodiment of this aspect, the sewer line further comprises a receiver to receive and discharge dry weather flow.

In another aspect, the present invention provides a vacuum break device for an automatic vacuum flushing system, comprising:

a chamber formed by an outside screen wall, a bottom plate and a top plate;

a plurality of bars installed vertically connecting the top and bottom plates of the chamber to form a frame;

a positioning tube installed vertically on the bottom plate of the chamber;

a plurality of floatable parts, each comprising a central hole, placed along the positioning tube, the floatable parts optionally mounted on the bars of the frame through holes;

a weight positioned above one of the floatable parts; and a rubber sheet above the top of the floatable parts and directly beneath the bottom opening of the pipe coming from the top of the chamber, the rubber sheet capable of tightly sealing the pipe opening when in position;

wherein the rubber sheet, the floatable parts, and the weight are arranged so that the rubber sheet can seal the pipe opening when water level rises in the sewer or storage tank and during the formation of vacuum when the water in the sewer or storage tank is drained until a predetermined level.

In one embodiment of this aspect, the floatable parts comprise:

a floating plate at the bottom directly beneath the weight;

a rubber sheet holder on the top to hold the rubber sheet, the holder comprising a plate fixed on the top of a rod, the rod inserted downwardly into said positioning tube so that the bottom floating plate, the weight, the rubber sheet holder, and the rubber sheet are aligned along the positioning tube from bottom to the top, and can freely move up and down along the positioning tube;

wherein the rubber sheet is connected to the weight by two or more strings or chains; and wherein the rubber sheet moves upward to seal the opening of the pipe when water level rises to move the floatable parts upward; a vacuum is created when the water level falls; and when the water level falls to a predetermined level, the weight applies a force to the rubber sheet through the strings or chains to rapidly break the vacuum.

In one embodiment of this aspect, the floatable parts further comprise a positioning part placed between the weight and the top place of the rubber sheet holder.

In another embodiment of this aspect, the bottom floatable part and the weight have holes traversed through by the same number of bars.

In another embodiment of this aspect, the number of bars is four (4).

In another aspect, the present invention provides a vacuum break device for automatic vacuum flushing systems, comprising:

a mechanical part fixed on the top of the flush water chamber encompassing the air release valve, and a floatable part connected to the mechanical part through a lever system, wherein the floatable part, through the lever system, causes the mechanical part to suddenly open the air release valve and break the vacuum in the headspace of the flush water chamber, when water level in the sewer or storage tank falls to a predetermined level.

In one embodiment of this aspect, the mechanical part comprises:

a shooting part connected to a lever arm of said lever system through a connecting means (e.g., a pin, pivot, or the like) and capable of moving up and down along a positioning rod, the shooting part connected to the top of the flush water chamber through a spring wrapping around the positioning rod, both the spring and positioning rod fixed on the top of the flush water chamber, optionally through a positioning plate, and a handle fixed on the shooting part, the handle connected to the air release valve through a string or chain, wherein the shooting part is capable of opening and closing the air release valve through the string or chain connecting the handle and the valve.

In another embodiment of this aspect, the mechanical part further comprises a supporting structure to hold the pivot of the lever system, and a positioning structure to hold the shooting part in place when the air release valve is closed.

In another embodiment of this aspect, the floatable part is located at the upstream or side of the flush water chamber.

In another aspect, the present invention provides an automatic vacuum flushing system for flushing or cleaning sewer or storage tank sediment in a drainage system, comprising a vacuum break device according to any embodiment described herein.

In another aspect, the present invention provides a method of flushing or cleaning sewer or storage tank sediment in a drainage system, comprising the steps of:

providing at least one of the automatic vacuum flushing systems according to any embodiment described herein;

placing said at least one of the automatic vacuum flushing systems in an upstream portion of the drainage system;

allowing water level to rise so as to substantially fill the flush water chamber;

draining the water from the sewer or storage tank to create a vacuum in the headspace of the flush water chamber;

allowing the water level in the sewer or storage tank to fall to a predetermined level so that the vacuum in the headspace of the flush water chamber breaks rapidly, causing discharge of the water in the flush water chamber in a surge to flush out the sediment from the sewer or storage tank.

In one embodiment of this aspect, the drainage system is selected from the group consisting of combined sewer systems, separated sanitary sewer systems, and storm water sewer systems.

In another embodiment of this aspect, the drainage system comprises at least one sewer line or storage tank for one or more of combined sewer overflow, separated sanitary sewer overflow, and storm water overflow Other aspects of the present invention include vacuum break devices and automatic vacuum flushing systems essentially as shown and described, and use of the vacuum break devices and/or flushing systems as shown and described in a storage tank, a storm water sewer line, or a combined sewer line.

The amount of sediment that can be removed from the sewer or storage tank bottom depends on the strength of the flushing wave. The strength of the flushing wave depends on the volume of the water in the vacuum chamber and on how quickly the water evacuates the chamber. The speed at which water is released from the vacuum chamber greatly depends on how quickly the vacuum breaks.

The following non-limiting examples illustrate certain aspects of the present invention.

EXAMPLES

Example 1

Vacuum Break Device (Type 1)

Figure 1B:
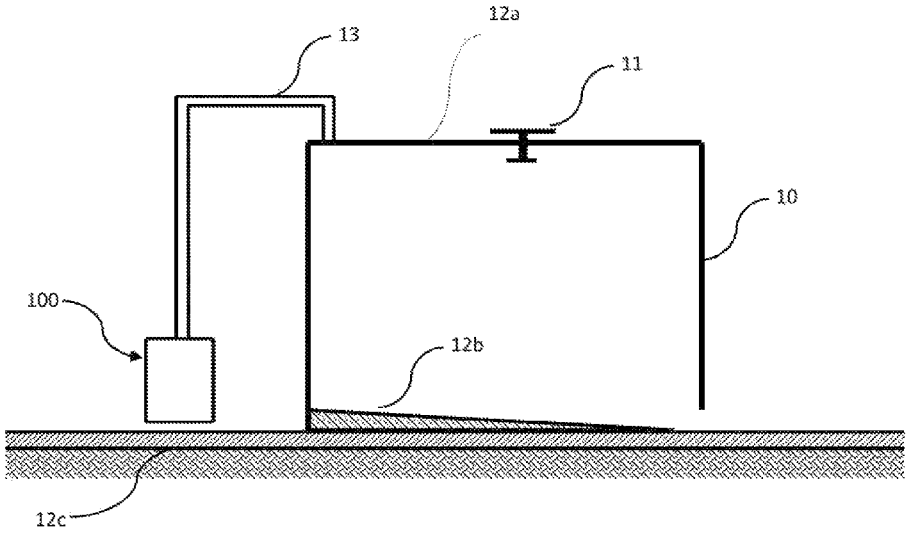
FIG. 1B illustrates a cross-sectional view of the flushing system taken along the line 1-1 of FIG. 1A, showing the air release valve 11 in its open state, the inlet and out port located at the bottom of the downstream sidewall, and the elevation view of the rapid vacuum break device 100 and the connection pipe 13.
Figure 1C:
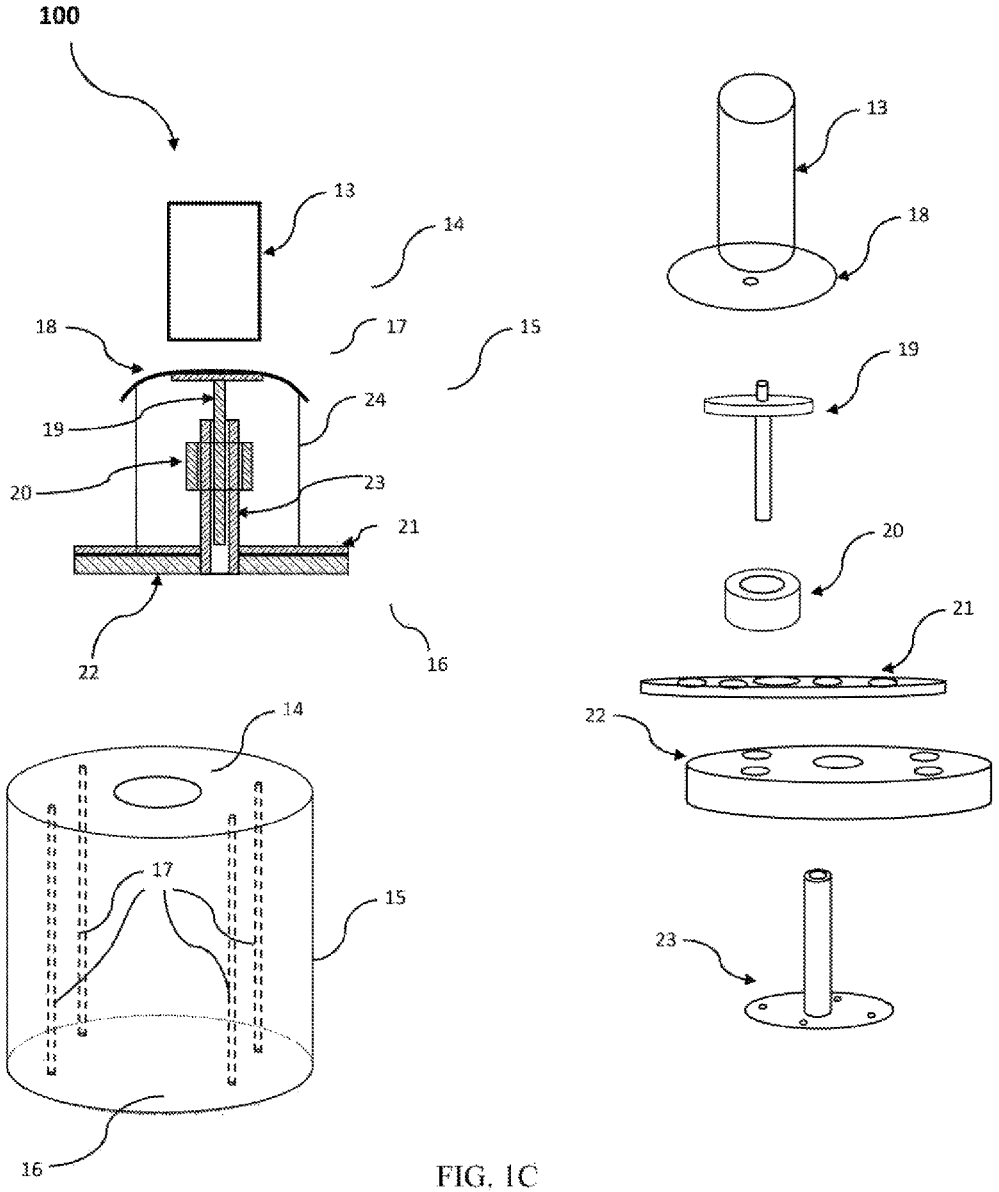
FIG. 1C illustrates the components of one embodiment of the rapid vacuum break device 100.

The first type of new vacuum break device is illustrated in FIGS. 1A, 1B and 1C. It consists essentially of a circular outside chamber wall 15 in the form of a screen to prevent large solids from entering the chamber, and a plurality of inside floatable components. The floatable components are mounted on four bars 17 of the frame and can freely move up and down. The whole frame is connected to the bottom of the vacuum pipe 13. The floatable parts include a rubber sheet 18 on the top, two floatable parts 20 and 22, a weight 21 located above the floatable part 22, and a connecting means, for example, a pair of stainless chains or nylon strings 24, to connect the rubber sheet 18 and the weight 21 together. The two chains or strings are connected symmetrically to the edge of the rubber sheet, and their lengths are determined by the predetermined water release level. When water level rises, the floatable part will move up and touch the bottom of the pipe 13. When water level falls, a vacuum will be created in the flushing tank 10, and the rubber sheet 18 will be held up to seal the pipe opening by the suction force. When the water level falls to a predetermined level, the weight 21 will apply a force to the rubber sheet 18 through the two chains which quickly break the vacuum. The reason for using the rubber sheet material is that it is flexible. When water level falls below the interface between the vacuum break pipe opening and the rubber sheet, the circumference of this interface is exposed to the atmosphere. Therefore, when a force (perpendicular to the rubber sheet surface) is applied to the edge of rubber sheet, the flexible rubber sheet at that side will deform and tend to move away from the interface. This trend will allow the atmosphere easily entering the interface between the pipe opening and rubber sheet to easily break the vacuum pressure. At this situation, no large force is required to break the vacuum.

Example 2

Automatic Flushing System (Type 1)

A brief description of the various components of a Flushing System using the vacuum breaking device of type 1 (FIGS. 1A, 1B and 1C) is provided below:

10 Flush water chamber wall;

11 Air release valve used to release air from the flush water chamber when water rises in the chamber;

12*a* Top of flush water chamber;

12*b* Floor of the chamber with a slope of 5 to 20% to prevent debris accumulation in the chamber;

12*c* Floor of storage tank or sewer line;

13 A pipe used to transport the air into the chamber when the formulated vacuum in the headspace of the chamber is broken by the vacuum-break device (100);

14 Top of vacuum break device;

15 Chamber screen wall of vacuum break device used to prevent large solids entering the chamber;

16 Bottom of vacuum break device;

17 Four vertical bars used to connect the top and bottom of the vacuum break device to form a frame;

18 A rubber sheet which fixed on the rubber sheet holder (19) used to seal the bottom opening of the pipe (13) when water rises;

19 Rubber sheet holder used to position and hold the rubber sheet;

20 A floatable part used to lift the rubber holder to seal the opening of the pipe (13) when water level rises;

21 A weight used to apply a force to the rubber sheet edge through the strings or chains to rapidly break the vacuum when water level falls to a predetermined level;

22 A floatable part used to balance the weight (21) so that the floatable parts move upwards freely when water level rises;

23 Positing tube fixed on the bottom of the vacuum break device chamber to make sure the floatable parts move up and down vertically;

24 Stainless chains or nylon strings used to connect the rubber sheet (18) and the weight (21) together.

Example 3

Vacuum Break Device (Type 2)

Figure 2A:
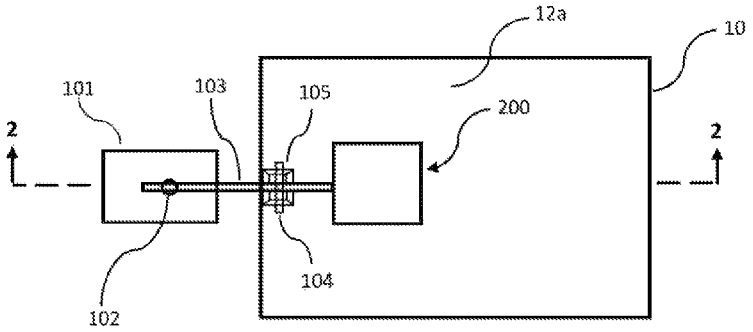
FIG. 2A is a top plan view of the automatic vacuum flushing system 2 of the invention, illustrating another rapid vacuum break device 200 mounted on the top of the flushing reservoir 10, a float 101 connected through a connection pin or pivot 102 with the lever system 103, 105 to the vacuum break system 200.
Figure 2B:
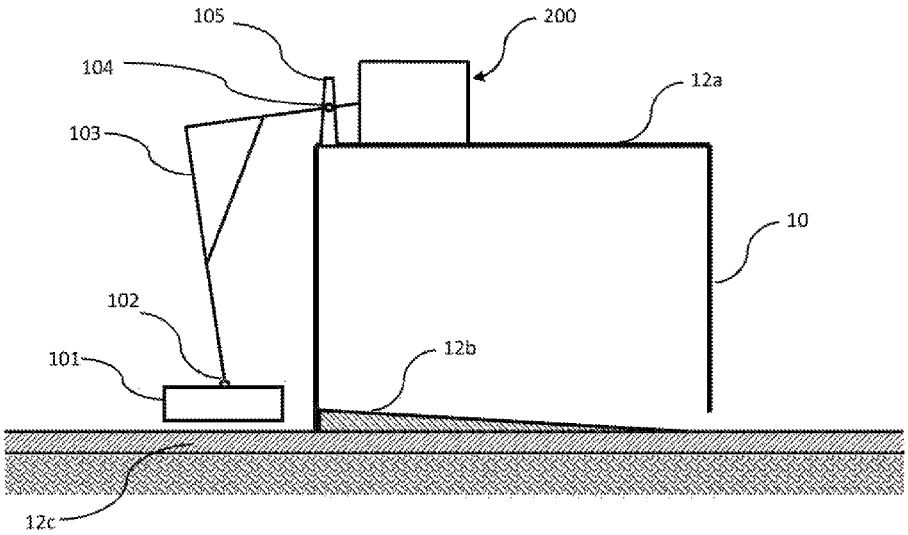
FIG. 2B is a cross-sectional view of the flushing system 2 taken along the line 2-2 of FIG. 2A, illustrating the inlet and out port located at the bottom of the downstream sidewall, and the components and their connections of the float 101, the lever systems 102, 103, 104, 105, and the vacuum break device 200.
Figure 2C:
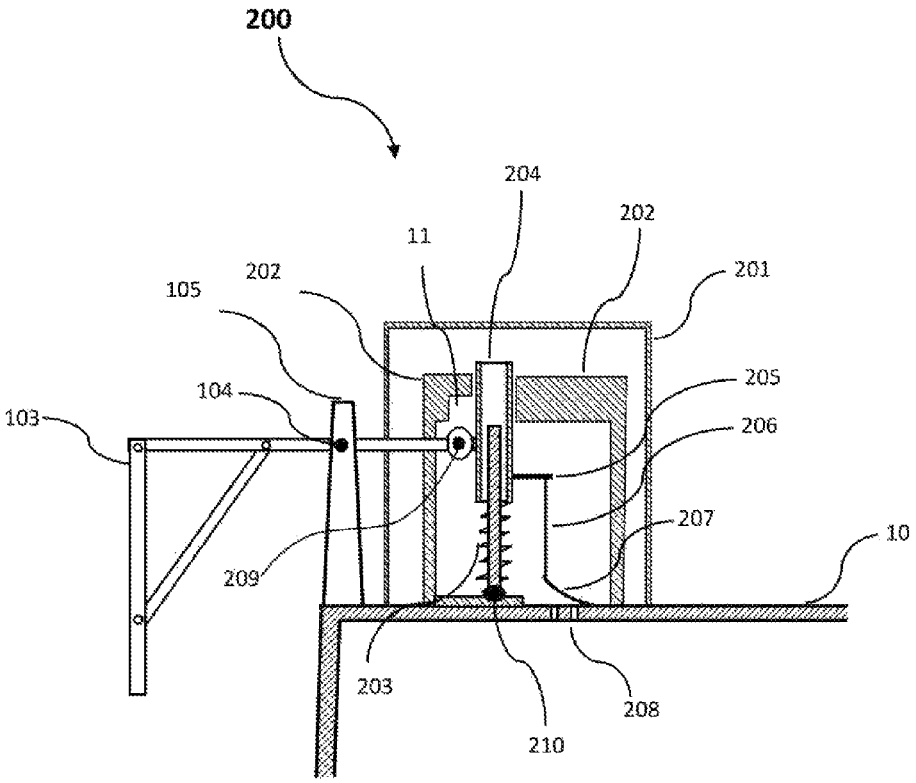
FIG. 2C illustrates the components of one embodiment of the rapid vacuum break device 200 and their connections.

The second type of novel vacuum break device is illustrated in FIGS. 2A, 2B and 2C. It consists essentially of a mechanical part 200 which is designed to suddenly break the vacuum, and a floatable part 101 which is connected to the mechanical part 200 by the lever system 103. When in use, the vacuum break device is mounted on the top of the flushing chamber 12*a*. The detailed illustrations for the mechanical part 200 are shown in FIG. 2C. The mechanical part 200 is fixed above the top of the air release and vacuum break valve 207, and connected to the valve with a certain length chain 206 as shown in FIG. 2C. When water level rises, the floatable part 101 moves up and applies a force through the lever system 103 to the shooting part 204 to move down, and the spring 203 is compressed. With increasing water level, the air release and vacuum break valve 207 will sit on the top of the flushing tank 12*a* but allows the air releasing, and the shooting part 204 will move down and into the trough 11 to hold there. When water level falls, a vacuum is created in the flushing chamber, and the air release and vacuum break vale 207 is closed due to the suction force. With further falling of the water level, the floatable part 101 continuously moves down. When the water level falls to a predetermined level, i.e. the arms of the lever system rotates about the pivot 104 to the horizontal location, the arm will push the shooting part 204 out of the trough 11. Due to the sudden release of spring compression force 203, the shooting part 104 will fire up to bring the air release and vacuum break valve 207 to open and suddenly break the vacuum in the tank.

Example 4

Automatic Flushing System (Type 2)

A brief description of the various components of a Flushing System equipped with the vacuum breaking device of type 2 (FIGS. 2A, 2B and 2C) is provided below:

10 Flush water chamber wall;

11 Trough to hold the shooting part when water level rises to a certain level;

12*a* Top of flush water chamber;

12*b* Floor of the chamber with a slope of 5 to 20% to prevent debris accumulation in the chamber;

12*c* Floor of storage tank or sewer line;

101 A floatable part used to apply a lift force to the lever system (103);

102 A pin or pivot used to connect the floatable part (101) and the lever system (103);

103 Lever system used to control the vacuum break device (200) for rapidly breaking the vacuum;

104 The pivot of lever system;

105 Structure to the lever system;

200 Mechanical vacuum break device;

201 Box used to cover the mechanical vacuum break device and prevent the dirt and animals entering the device;

202 A frame with a top plate installed on the top of the flush water chamber—there is a hole on the top plate to guide the movement of the shooting part (204) and a trough to hold the shooting part by lever system with the water level falling and rising;

203 A spring used to provide the shooting force;

204 A shooting part used to rapidly break the vacuum;

205 A handle fixed on the shooting part (204) and connected to the air release and vacuum break rubber valve (207) through a string or a chain—when water level falls to the predetermined level, the shooting part is activated, and thus the air release and vacuum break rubber valve is suddenly opened, i.e., the vacuum is rapidly broken;

206 A String used to connect the shooting part and the air release rubber valve;

207 Air release and vacuum break rubber valve—when water level rises, the shooting part moves downwards and finally hold in the trough and the air release and vacuum break rubber sheet sits on the air release openings (208) of flushing water chamber and let the air release from the chamber freely; while water level falls, the air release and vacuum break rubber sheet seals the air release openings to form the vacuum in headspace. When water level falls to the predetermined level, the lever system will activate the shooting part to open the air release and vacuum break valve to break the vacuum;

208 Air release openings from the flush water chamber;

209 A pin or pivot used to connect the lever system (103) and the shooting part (204).

As a person of ordinary skill in the art would appreciate, the vacuum break devices of the present invention can be in any sizes to suit particular flushing systems based on the need, which could vary depending on various factors known to those skilled in the art.

Example 5

Demonstration of the Automatic Flushing Systems

Existing Laboratory Flume and Flushing Tank (Chamber)

The existing laboratory flume and flushing tank (chamber) were used to simulate a research of sewer or storage tank. The channel is located in the Fluid Mechanics/Hydraulics Laboratory in the Department of Civil and Environmental Engineering at Rutgers University. It is a self-contained, re-circulating channel, designed for use as a student laboratory flume and for small scale sediment transportation studies. The unit consists of a transparent plexiglass channel, a head tank with an adjustable undershot gate, an adjustable tailgate, a reservoir, two circulating pumps, and a flow metering system. The supporting framework incorporates an elevating mechanism for varying the slope of the channel bed. All wetted parts of the equipment are made of non-corrosive materials.

The overall dimensions of the channel are: Length, 19 feet 5 inches (5.92 m); Width, 8 feet 10 inches (2.69 m); Height, 6 feet 10 inches (2.08 m). Working section of the channel is 12 inches (30 cm) wide, 18 inches (46 cm) deep, 15 feet (4.57 m) long (from head gate to tail gate) and is fabricated from 0.5 inch (13 mm) thick, clear plexiglass. The channel discharges into a 32.0 $ft^3$ (0.91 $m^3$) reservoir fabricated from a composite lamination of fiberglass and rigid PVC foam core.

The flushing chamber was placed at the head of the flume. Outside dimensions of the tank are: 36 inches (0.91 m) high, 36 inches (0.91 m) long, and 11 inches (28 cm) wide. One-inch (25 mm) thick Acrylic sheet was used to make the top cover, bottom floor, and four sidewalls. Therefore, the inside dimensions of the tank are: 34 inches (86 cm) high, 34 inches (86 cm) long, and 9 inches (23 cm) wide. Three 6-inch (15 cm) holes are cut on the top cover of the tank. Two of the three holes on the top cover are closed with thermal plugs, and the third hole is connected to a 6-in PVC standpipe. A vertical gate/plate is attached to the downstream wall of the flushing tank. A metal frame is clamped to the gate/plate to hold it against side of the tank and to maintain a desired downstream gap height.

Materials Used in Experiments

Water used in the flushing tests was taken from the public water supply tap in the laboratory.

Experimental Equipment

A digital video camera was used to record water movement during laboratory flushing. The video camera records 30 picture frames per second. Spatial positions were established using markings on the flushing tank and the flume.

Experimental Design

The laboratory tests were conducted based on three flushing systems: One is USEPA's automatic vacuum flushing system; the other two are based on the present invention (FIG. 1 and FIG. 2). The flushing processes were videotaped. The recorded video images were digitized to obtain data on water draining velocity in the flushing tank, and speed of the flushing flow along the flume.

For flushing system 1 of this invention, The rapid vacuum break device 100 was mounted to the bottom of the standpipe. For flushing system 2 of this invention, the vacuum break device 200 was mounted on the top of the flushing tank.

Experimental Procedures

Without intending to be bound, an illustrative example of the experimental procedure is described as follows:

a. Constructed flushing tank was placed at the head of the flume. The flume was at horizontal level.
b. Markings were made on the walls of the flume and the flushing tank to indicate spatial positions.
c. Tailgate of the flume was raised to a desired height (15 inches).
d. Water was pumped into the flume to achieve a desired water depth (15 inches) in the flume.
e. A digital video camera was placed in front of the flume with a view of the flushing tank and the flume.
f. Digital video camera was turned on.
g. Water in the flume was drained by lowering the tailgate of the flume to a desired level (5.0 inches above the flume bottom). Vacuum was thus created inside the flushing tank holding water at a terminal level (13.5~14.0 inches above the flume bottom). When water level upstream of the flushing tank was drained (through the leaking of tailgate) below bottom edge of the standpipe (2.5 inches above the flume bottom), air gradually entered through the standpipe breaking the vacuum inside headspace of the flushing tank, and water was released from the tank, generating a flushing wave. Due to the narrow width (0.5 inch) between the sidewall of the flushing tank and the sidewall of the flume, water level upstream of the flushing tank was higher than water level downstream of the flushing tank, and a small opening under the upstream control gate was employed to balance the water levels between upstream and downstream (if necessary) so that the vacuum was broken by air coming in through the standpipe opening, not the downstream sidewall opening.
h. Digital video camera was turned off.

Experimental Results and Discussion

Laboratory test results from use of the USEPA's flushing system indicated that the strength of the flushing wave greatly depended on the length of vacuum break time. The shorter the vacuum break time was, the higher the strength of the flushing wave became. The laboratory demonstrations indicated that the vacuum break time greatly depended on the falling speed of the water level outside the tank. However, for sewers or storage tanks with water levels falling gradually, this flushing system may not work efficiently for sediment removal due to the weak flushing wave created.

In contrast, the laboratory demonstrations using the flushing systems 1 and 2 of this invention have shown that they worked very effectively, in a similar manner to flushing gates. When the water level fell to a predetermined level, the vacuum broke suddenly in both systems. As a person of ordinary skill in the art would be able to appreciate, in principle these new systems can be applied to any field conditions.

As a person of ordinary skill in the art would also appreciate, the vacuum break devices of the present invention could also vary in shape, so long as they can serve to rapidly break the vacuum when water fills up in the storage tank until a pre-determined level and thus enabling release of water to cause a current to flush sediments downstream. Therefore, it will be understood by those skilled in the art that numerous and various modifications can be made without departing from the spirit of the present invention. Therefore, the various embodiments and examples of the present invention described herein are illustrative only and not intended to limit the scope of the present invention.

The invention claimed is:

1. A vacuum break device for automatic vacuum flushing systems, comprising:

a mechanical part fixed on the top of a flush water chamber enclosing an air release valve, and a floatable part located at the upstream or side of the flush water chamber and connected to the mechanical part through pivot of a lever system, wherein the floatable part, through the lever system, causes the mechanical part to suddenly open the air release valve and break the vacuum in the headspace of the flush water chamber, when water level in the sewer or storage tank falls to a predetermined level; and wherein the vacuum in the headspace of the flush water chamber is self-generated during natural draining of water outside the flush water chamber with no external power or water supply required.

2. The vacuum break device of claim 1, wherein said mechanical part comprises:

a shooting part connected to a lever arm of said lever system through a connecting means and capable of moving up and down along a positioning rod, the shooting part connected to the top of the flush water chamber through a spring wrapping around the positioning rod, both the spring and positioning rod fixed on the top of the flush water chamber, optionally through a positioning plate, and a handle fixed on the shooting part, the handle connected to the air release valve through a string or chain, wherein said mechanical part comprises a supporting structure to hold the pivot of said lever system and a positioning structure to hold the shooting part in place when the air release valve is closed; and wherein the shooting part is capable of opening and closing the air release valve through the string or chain connecting the handle and the valve.

3. An automatic vacuum flushing system for flushing or cleaning sewer or storage tank sediment in a drainage system, comprising a vacuum break device of claim 1.

4. An automatic vacuum flushing system for flushing or cleaning sewer or storage tank sediment in a drainage system, comprising a flush water chamber, an air release valve on the top of the flush water chamber, and a vacuum-break device of claim 1 connected to the top of the flush water chamber, wherein the flush water chamber comprises an opening in its lower part on the drainage downstream side and is in fluid communication with the drainage system through the opening; and wherein the flush water chamber substantially fills up with water from the drainage through the opening when the water level in the storage tank or sewer rises; a vacuum is created in the headspace of the flush water chamber when water in the sewer or storage tank is drained; and when water in the storage tank or sewer falls below a level, the vacuum-break device rapidly breaks the vacuum, thereby discharging the water in the flush water chamber in a surge to flush the sewer or storage tank.

5. The automatic vacuum flushing system of claim 4, wherein the mechanical part of said vacuum-break device comprises:

a shooting part connected to a lever arm of said lever system through a connecting means and capable of moving up and down along a positioning rod, the shooting part connected to the top of the flush water chamber through a spring wrapping around the positioning rod, both the spring and positioning rod fixed on the top of the flush water chamber, optionally through a positioning plate, and a handle fixed on the shooting part, the handle connected to the air release valve through a string or chain, wherein the shooting part is capable of opening and closing the air release valve through the string or chain connecting the handle and the valve.

6. The automatic vacuum flushing system of claim 5, wherein the mechanical part of said vacuum-break device further comprises a supporting structure to hold the pivot of the lever system, and a positioning structure to hold the shooting part in place when the air release valve is closed.

7. The automatic vacuum flushing system of claim 4, wherein velocity of the flushing water surge is at least at a level sufficient to suspend and flush out the sediment, said level of velocity being dependent on sizes and specific gravity of the sediment or field deposits.

8. The automatic vacuum flushing system of claim 7, wherein said level of the velocity of the flushing water surge is at least about 1 m/s, at least about 2 m/s, at least about 3 m/s, or at least about 4 m/s.

9. The automatic vacuum flushing system of claim 4, wherein said opening in the lower part of the flush water chamber is at least about one inch above the historical height of the sewer or storage tank sediment layer immediately downstream of the flush water chamber.

10. The automatic vacuum flushing system of claim 4, wherein said water level in the sewer or storage tank for vacuum-break is located at the level immediately above the top of the opening.

11. The automatic vacuum flushing system of claim 4, wherein said water level in the sewer or storage tank for vacuum-break is located within about one inch, about two inches, or about three inches above the top of the opening.

12. The automatic vacuum flushing system of claim 4, wherein the volume of the flush water chamber is at least about 5-10%, at least about 10-15%, about 15-20%, or about 20-25% of the volume of the storage tank to be flushed or at least about 10-20%, about 20-30%, about 30-40%, about 40-50%, or about 50-60% of the volume of the total length of the sewer line to be flushed.

13. A method of flushing or cleaning sewer or storage tank sediment in a drainage system, comprising the steps of:

providing at least one automatic vacuum flushing system of claim 3; and placing said at least one automatic vacuum flushing system in an upstream portion of the drainage system.

14. A vacuum break device for automatic vacuum flushing systems, comprising:

a mechanical part fixed on the top of the flush water chamber encompassing the air release valve, and a floatable part connected to the mechanical part through a lever system, a shooting part fixed on a lever arm of said lever system and capable of moving up and down along a positioning rod, the shooting part connected to the top of the flush water chamber through a spring wrapping around the positioning rod, both the spring and positioning rod fixed on the top of the flush water chamber, optionally through a positioning plate, and a handle fixed on the shooting part, the handle connected to the air release valve through a string or chain, wherein the shooting part is capable of opening and closing the air release valve through the string or chain connecting the handle and the valve; and wherein the floatable part, through the lever system, causes the mechanical part to suddenly open the air release valve and break the vacuum in the headspace of the flush water chamber, when water level in the sewer or storage tank falls to a predetermined level.

15. The vacuum break device of claim 14, wherein said mechanical part further comprises a supporting structure to hold the pivot of the lever system, and a positioning structure to hold the shooting part in place when the air release valve is closed.

16. The vacuum break device of claim 14, wherein the floatable part is located at the upstream or side of the flush water chamber.

17. An automatic vacuum flushing system for flushing or cleaning sewer or storage tank sediment in a drainage system, comprising a vacuum break device of claim 14.

18. A method of flushing or cleaning sewer or storage tank sediment in a drainage system, comprising the steps of:

providing an automatic vacuum flushing system of claim 14;

placing said automatic vacuum flushing systems in an upstream portion of the drainage system;

allowing water level to rise so as to substantially fill the flush water chamber;

draining the water from the sewer or storage tank to create a vacuum in the headspace of the flush water chamber;

allowing the water level in the sewer or storage tank to fall to a predetermined level so that the vacuum in the headspace of the flush water chamber breaks rapidly, causing discharge of the water in the flush water chamber in a surge to flush out the sediment from the sewer or storage tank.

19. The method of claim 18, wherein the drainage system selected from the group consisting of combined sewer systems, separated sanitary sewer systems, and storm water sewer systems.

20. The method of claim 18, wherein the drainage system comprises at least one sewer line or storage tank for one or more of combined sewer overflow, separated sanitary sewer overflow, and storm water overflow.

* * * * *